US005378862A

United States Patent [19]

Tasaka et al.

[11] Patent Number: 5,378,862

[45] Date of Patent: Jan. 3, 1995

[54] UNIVERSAL PIVOT SWITCH WITH A HEMISPHERIC PIVOTAL SUPPORT MEMBER

[75] Inventors: Hideo Tasaka, Akigawa; Masaaki Hirai, Fussa, both of Japan

[73] Assignee: Casio Computer Co., Ltd., Tokyo, Japan

[21] Appl. No.: 102,582

[22] Filed: Aug. 5, 1993

[30] Foreign Application Priority Data

Aug. 18, 1992 [JP] Japan ..... 4-241305
Nov. 30, 1992 [JP] Japan ..... 4-345461

[51] Int. Cl.[6] ..... H01H 9/00; H01H 19/00
[52] U.S. Cl. ..... 200/6 A; 200/4
[58] Field of Search ..... 200/4, 5 R, 5 A, 6 R, 200/6 A, 6 B, 6 BA, 6 BB, 6 C, 16 R, 16 B, 16 C, 16 D, 17 R, 18, 302.1, 302.3, 553, 329, 339

[56] References Cited

U.S. PATENT DOCUMENTS 4,255,626 3/1981 Watts et al. ..... 200/6 A
4,386,254 5/1983 Eberhardt et al. ..... 200/339
4,395,134 7/1983 Luce ..... 368/3
4,408,103 10/1983 Smith, III ..... 200/6 A
4,428,649 1/1984 Main et al. ..... 350/289
4,476,356 10/1984 Nakayama et al. ..... 200/6 A
4,739,127 4/1988 Higuchi et al. ..... 200/5 R
5,115,108 5/1992 Ogawa et al. ..... 200/1 B

*Primary Examiner*—A. D. Pellinen
*Assistant Examiner*—Michael A. Friedhofer
*Attorney, Agent, or Firm*—Frishauf, Holtz, Goodman & Woodward

[57] ABSTRACT

A switch which provides different switching inputs by pushing different operating portions of a single operating button is disclosed. The switch comprises an operating button the periphery of which has a plurality of operating portions, a support provided at the center of the rear portion of the button, a casing having a plurality of through-holes defined opposite the operating portions of the button, and a plurality of operating shafts received in the through-holes. The rear surface of the button has bosses in and out of point-contact with the operating shafts. Although the bosses are rotated about the support for the button, the operating shafts receives simple axial forces. This secures good operation of the switch.

8 Claims, 4 Drawing Sheets

UNIVERSAL PIVOT SWITCH WITH A HEMISPHERIC PIVOTAL SUPPORT MEMBER

BACKGROUND OF THE INVENTION

1. Field of the Invention

The present invention relates to a switch in which different portions of an operating button are pushed to enter different switching inputs.

2. Description of the Related Art U.S. Pat. Nos. 4,395,134; 4,408,103; and 4,428,649 disclose switches having switching terminals at positions under a single operating button and providing different switching inputs by different directions and positions of push.

In such switches, since the directions and positions of push are changed about a lower operational center of the button, an operating shaft for entering switching inputs mounted to or under the button is moved longitudinally, transversely and vertically and it is difficult that the switch has a waterproof arrangement. If the switch positively has the waterproof arrangement, this arrangement must be complicated.

SUMMARY OF THE INVENTION

An object of the present invention is to provide a switch having a simple waterproof arrangement. To achieve this object, the present invention comprises an operating button the periphery of which has a plurality of operating portions, a support provided behind a rear portion of the operating button and associated with the center of the rear portion, a casing receiving the operating button and having a plurality of through-holes opposite to the operating portions, the through-holes surrounding the support, a plurality of operating shafts mounted within the through-holes such that the front end of each of the operating shafts is allowed to abut on the rear surface of a corresponding one of the operating portions, the rear end of that operating shaft passing into the casing, and a contact assembly mounted within the casing and including movable contacts and fixed contacts which are operated by the operating shafts.

This structure can easily waterproof the interior of the switch.

DETAILED DESCRIPTION OF THE PREFERRED EMBODIMENTS

Embodiments of the present invention will be described with reference to the drawings hereinafter.

EXAMPLE 1

Figure 1:
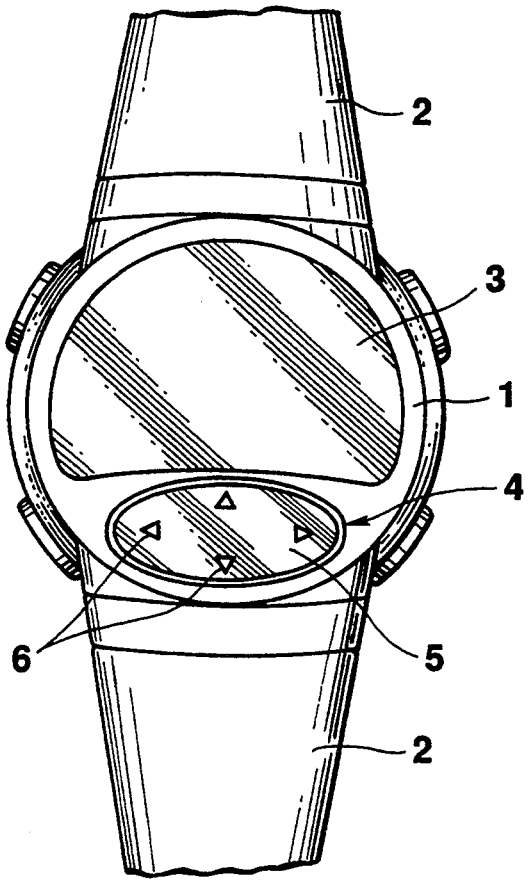
FIG. 1 is a front elevation of an electronic wrist watch having a switch according to EXAMPLE 1 of the present invention.
Figure 2:
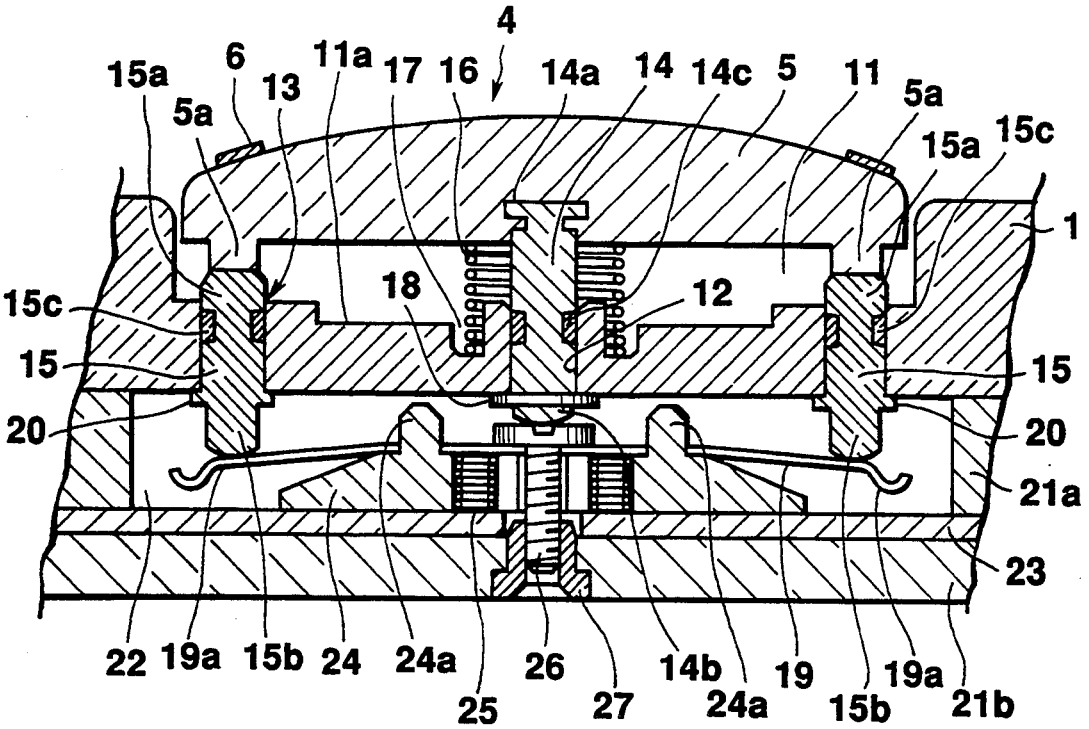
FIG. 2 is a sectional view of the switch in the electronic wrist watch of FIG. 1.
Figure 3:
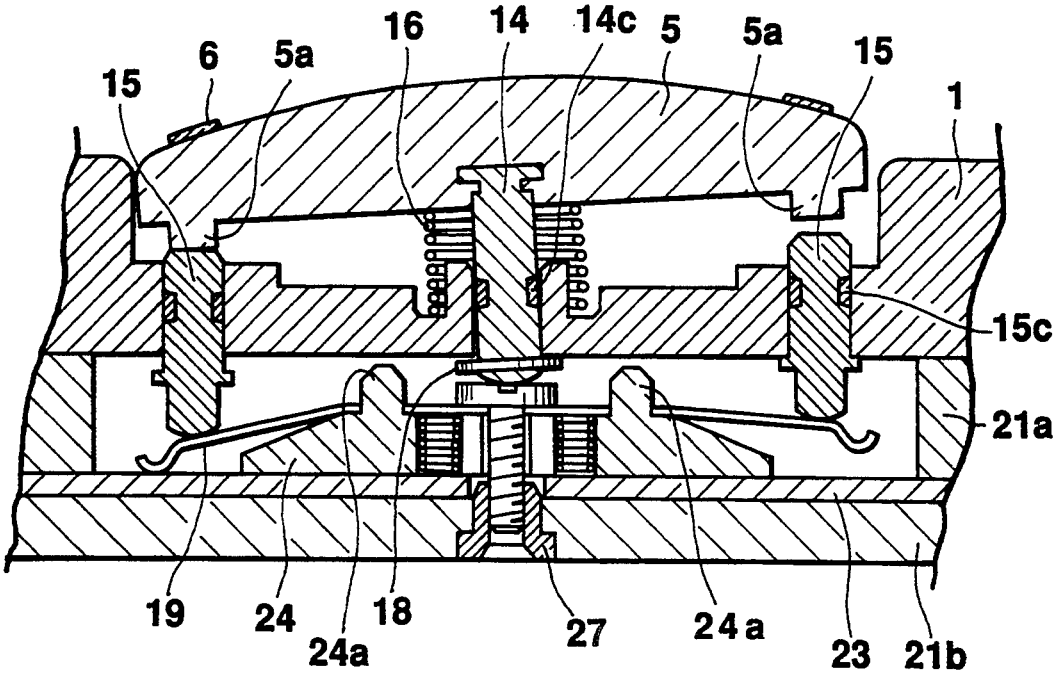
FIG. 3 is a sectional view of the switch of FIG. 2 indicative of operation of the switch.

FIGS. 1–3 show a switch in an electronic wrist watch according to EXAMPLE 1 of the present invention.

As shown in FIG. 1, an electronic wrist watch comprises a watch casing 1 of a metal or a synthetic resin, opposite sides of which have opposite ends of a wearing band 2, a display 3 mounted to a portion of the front portion of the casing 1 and displaying the time of day etc., and an elliptic operating button 5 of a switch 4 mounted to the remaining part of the front portion of the casing 1. The front surface of the push button 5 has four engraved or printed marks 6 to be pushed spaced along the periphery of the push button 5. The position of each mark 6 is associated with the position of a corresponding one of second shafts 15 described later, as shown FIGS.2 and 3.

FIGS. 2 and 3 show a section of the interior arrangement of the switch 4. The casing 1 has a depression 11 receiving the switch 4. The center of a bottom 11*a* of the depression 11 has a first single through-hole 12. Four second through-holes 13 are positioned in the bottom 11*a* of the depression 11 about the first through-hole 12. Each of the second through-holes 13 is provided behind a corresponding mark 6. A first shaft 14 is inserted into the first through-hole 12. The second shafts 15 are inserted into the second through-holes 13.

The first shaft 14 is fastened to the wall of the first through-hole 12. The operating button 5 is insert-molded so that the front end of the first shaft 14 is placed in the operating button 5 and the first shaft 14 is rigid with the operating button 5. The front end of the first shaft 14 terminates in a disc-shaped flange 14*a* received in the operating button 5. The flange 14*a* prevents the first shaft 14 from slippage from the operating button 5. A coil spring 16 is seated around the first shaft 14 between the bottom of an annular groove 17 surrounding a boss defining the first through-hole 12 and the center of the rear surface of the operating button 5. The coil spring 16 holds the operating button 5 in the horizontal position when a user of the electronic wrist watch does not push the operating button 5. The rear end 14*b* of the first shaft 14 projects from the rear edge of the first through-hole 12 and has a slippage prevention ring 18, such as an E-ring, fitted thereon. The outer diameter of the slippage prevention ring 18 is larger than the diameter of the first through-hole 12. The slippage prevention ring 18 is in contact with the rear surface of the casing 1 so as to prevent the first shaft 14 from slippage from the first through-hole 12. An annular groove defined in an intermediate portion of the first shaft 14 fitting the wall of the first through-hole 12 receives a packing 14*c* for waterproofing the interior of the casing 1 through the first through-hole 12.

As described above, the second shafts 15 inserted into the second through-holes 13 are associated with the marks 6 on the front surface of the operating button 5 (see FIG. 1). The front ends 15*a* of the second shafts 15 project from the front edges of the second through-holes 13 and are allowed to abut on the rear surface of the periphery of the operating button 5. The rear ends 15*b* of the second shafts 15 project from the rear edges of the second through-holes 13 and are continuously in contact with a switch lever structure 19 (described later). An intermediate portion of each of the second shafts 15 which projects from the rear edge of a corresponding second through-hole 13 has a flange 20 contacting the casing 1 to prevent the second shaft 15 from slippage from the second through-hole 13. The rear surface of the operating button 5 has bosses 5*a* in and out of contact with the front ends 15*a* of the second shafts 15. Depressing one of the second shafts 15 is independent of operation of the other second shafts 15. An annular groove of an intermediate portion of each of the second shafts 15 which fits the wall of a corresponding second through-hole 13 has a packing 15*c* for waterproofing the interior of the casing 1 through the second through-hole 13.

The front surface of the operating button 5 has such a convex shape so as to cover the front ends of the first shaft 14 and the second shafts 15. The center of the front surface of the operating button 5 is in the frontmost position of the electronic wrist watch. The shape of the operating button 5 enhances the beauty of appearance of the switch 4 and facilitates the switching operation.

The interior of the casing 1 receives a circuit board 23 sandwiched between watch frameworks 21*a* and 21*b*. The watch framework 21*a* defines an opening 22 on an operating button 5 side. The switching lever structure 19 having four movable contacts is mounted within the opening 22.

The switching lever structure 19 comprises the four movable contacts 19*a* extending to the rear ends of the second shafts 15. The center of the switching lever structure 19 is supported on a support 24 fixed to a front surface of the circuit card 23. The support 24 comprises bosses 24*a* passing through holes defined in the switching lever structure 19. Inserting the bosses 24*a* into the holes defined in the switching lever structure 19 fixes the switching lever structure 19 laterally. The center of the support 24 defines a hole receiving a coil spring 25 urging the switching lever structure 19 towards the operating button 5. The entire switching lever structure 19 is made of a leaf spring, so that the movable contacts 19*a* are continuously in contact with the rear ends of the second shafts 15 and urges them towards the operating button 5. Thus, the switching lever structure 19 serves as an resilient element so as to securely contact the front ends of the second shaft shafts 15 with bosses 5*a* provided on the rear surface of the operating button 5. In addition, the coil spring 25 adds to the resilient force of the switching lever structure 19 so as to further securely contact the second shafts 15 with the bosses 5*a* and quickly return the second shafts 15 from the depressed positions. The centers of the support 24, the circuit board 23 and the framework 21*b* have holes coaxial with one another. These holes receive a screw bolt 26 having a flat head. The flat head of the screw bolt 26 is in point-contact with and supports the rear end of the first shaft 14 which has a spherical surface. The diameter of the flat head of the screw bolt 26 is smaller than the inner diameter of the coil spring 25 so that the coil spring 25 adds to the resilient force of the switching lever structure 19. The rear or front end of the screw bolt 26 engages a nut 27, such as a push nut, fitting the hole in the framework 21*b*.

The point-contact joint between the rear end 14*b* of the first shaft 14 and the flat head of the screw bolt 26 facilitates a smooth inclination of the first shaft 14 during a switching operation of the operating button 5.

The circuit board 23 has printed fixed contacts (not shown) in and out of contact with the movable contacts 19*a* of the switching lever structure 19. Thus, depressing a particular mark 6 on the operating button 5 depresses a corresponding second shaft 15, as shown in FIG. 3, so that a corresponding movable contact 19*a* contacts a corresponding fixed contact on the circuit board 23. Releasing the operating button 5 enables the switching lever structure 19 to return the second shaft 15 to a position shown in FIG. 2.

Since the second shafts 15 are separate from the operating button 5 having the plurality of operating positions indicated by the marks 6, each second shaft 15 receives a force to contact a corresponding movable contact 19*a* with a corresponding fixed contact on the circuit board 23 along the axis of that second contact 15 even if depressing the operating button 5 rotates a particular boss 5*a* about the joint of the operating button 5 and the first shaft 14. Thus, this structure secures a good switching operation. As shown in FIG. 3, since the remaining bosses 5*a* leave the remaining second shafts 15 when the particular boss 5*a* contacts the corresponding second shaft 15, the remaining shafts 15 are not adversely influenced by the switching operation of the operating button 5 and remain in their inoperative position. Thus, this structure can provide a longer contact-making stroke than a conventional structure of a switch.

EXAMPLE 2

Figure 4:
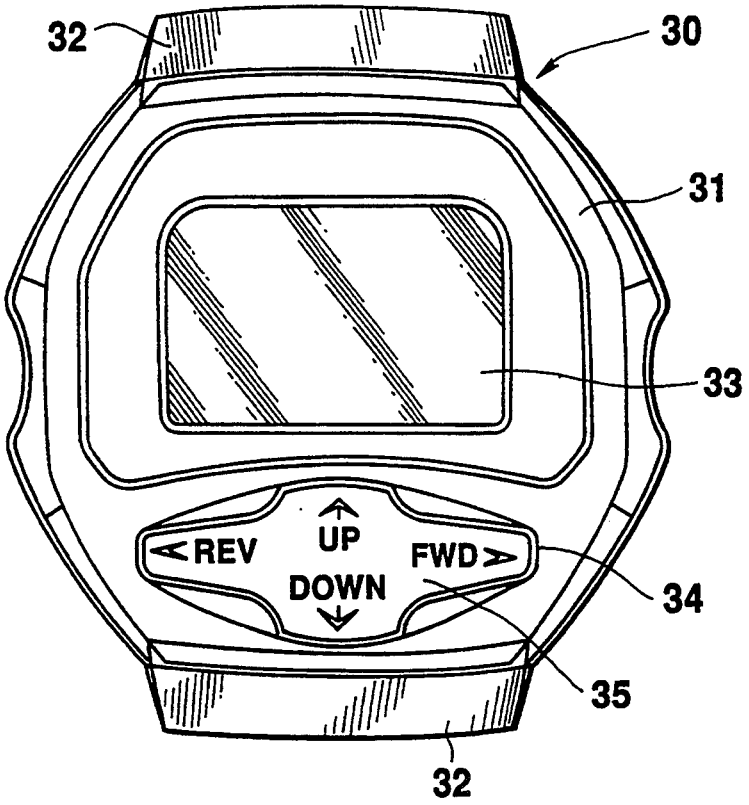
FIG. 4 is a front elevation of an electronic wrist watch having a switch according to EXAMPLE 2 of the present invention.

FIGS. 4–7 show EXAMPLE 2 of the present invention. As shown in FIG. 4, an electronic wrist watch 30 comprises a watch casing 31 of a synthetic resin having opposite connections 32 to a wearing band provided on the sides of six o'clock and twelve o'clock indicators, a display 33 displaying the time of day, names of persons, telephone numbers etc. and a switch 34 which is pushed to correct the display of the time of day, set functions, set data and read data. The switch 34 comprises an operating button 35 mounted on the front portion of the casing 31. The front surface of the operating button 35 has four pairs of a visual mark and a word for pushing operations which are printed or engraved on the front surface of the operating button 35 and spaced along the periphery of the front surface of the operating button 35. The positions of the four pairs of a visual mark and a word are associated with the positions of four movable shafts 44 of a metal (described later, see FIG. 5). Depressing a particular portion of the operating button 35 which bears a particular pair of a visual mark and a word depresses a corresponding movable shaft 44.

Figure 5:
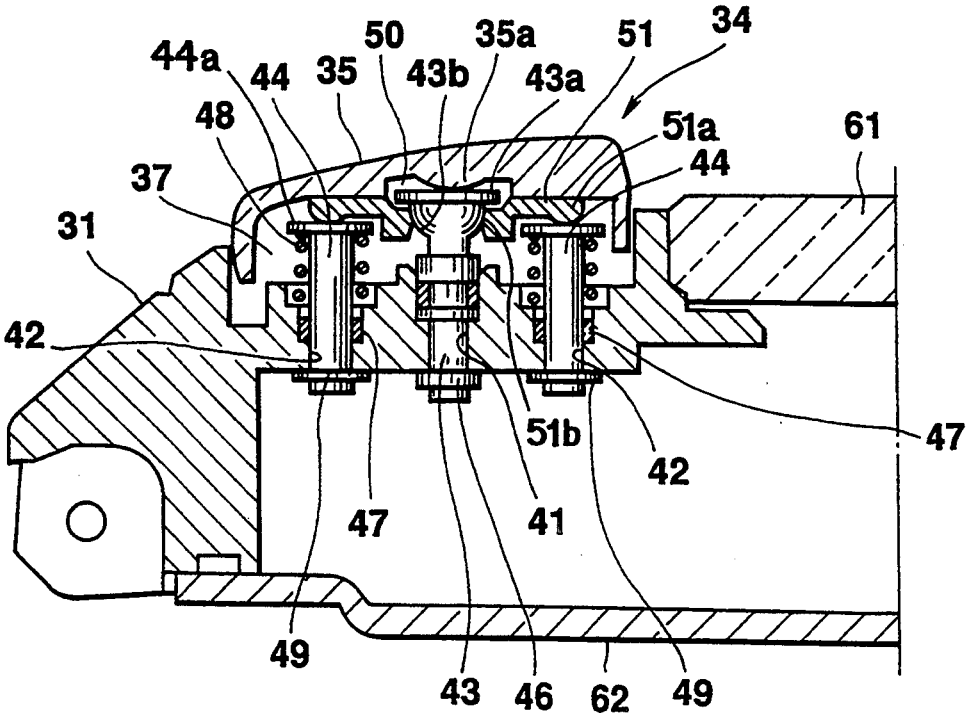
FIG. 5 is a sectional view of the switch in the electronic wrist watch of FIG. 4.

FIG. 5 is a section of the interior structure of the switch 34. The front portion of the casing 31 defines a depression 37 receiving an operating portion of the switch 34. The center of the bottom of the depression 37 has a through-hole 41 for mounting a fixed shaft 43. A plurality (e.g. four) of through-holes 42 defined in the bottom of the depression 37 surround the through-hole 41. The fixed shaft 43 is inserted into the through-hole 41. Movable shafts 44 are inserted into the through-holes 42.

The fixed shaft 43 has a hemispherical front end having a side surface 43*b*. The front surface 43*a* of the hemispherical front end of the fixed shaft 43 is flat. An inserted portion of the fixed shaft 43 comprises a front portion and a rear portion having a smaller diameter than the front portion. The front portion of the inserted portion of the fixed shaft 43 has an O-ring (see FIG. 6) 43*c* for waterproofing the interior of the switch 34. The rear end of the fixed shaft 43 projecting from the rear edge of the through-hole 41 has a slippage prevention ring 46, such as an E-ring, mounted thereon.

Each of the movable shafts 44 slides along the axis of a corresponding through-hole 42. The front end of the movable shaft 44 projects from the front edge of that through-hole 42. The movable shaft 44 is depressed to perform a switching operation. Although not shown, the switching lever structure 19 (see FIGS.2 and 3) constituting the movable contacts and the circuit board 23 having the fixed contacts are placed behind the fixed and movable shafts 43 and 44. An O-ring 47 is seated between each movable shaft 44 and the wall of an associated through-hole 42 to securely waterproof the interior structure of the switch 34. The movable shafts 44 are urged upwards by a spring means such as the switching lever structure. A rear limit of movement of the front surface 44*a* of each of the movable shafts 44 is slightly more rear than the position of the front surface 43*a* of the fixed shaft 43. The rear end of each movable shaft 44 projecting from the rear edge of the through-hole 42 has a slippage prevention ring 49.

Figure 6:
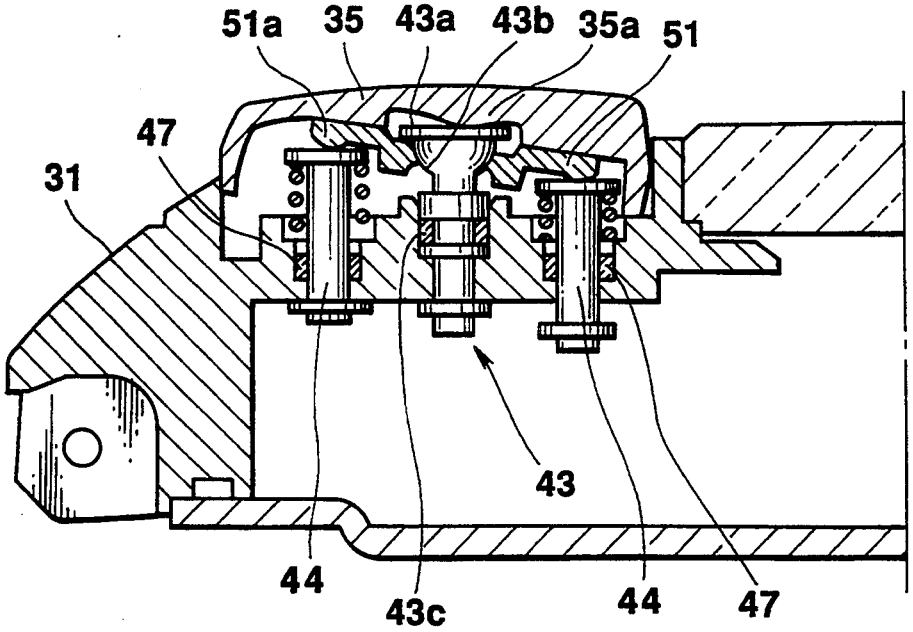
FIG. 6 is a sectional view of the switch of FIG. 4 indicative of operation of the switch.
Figure 7:
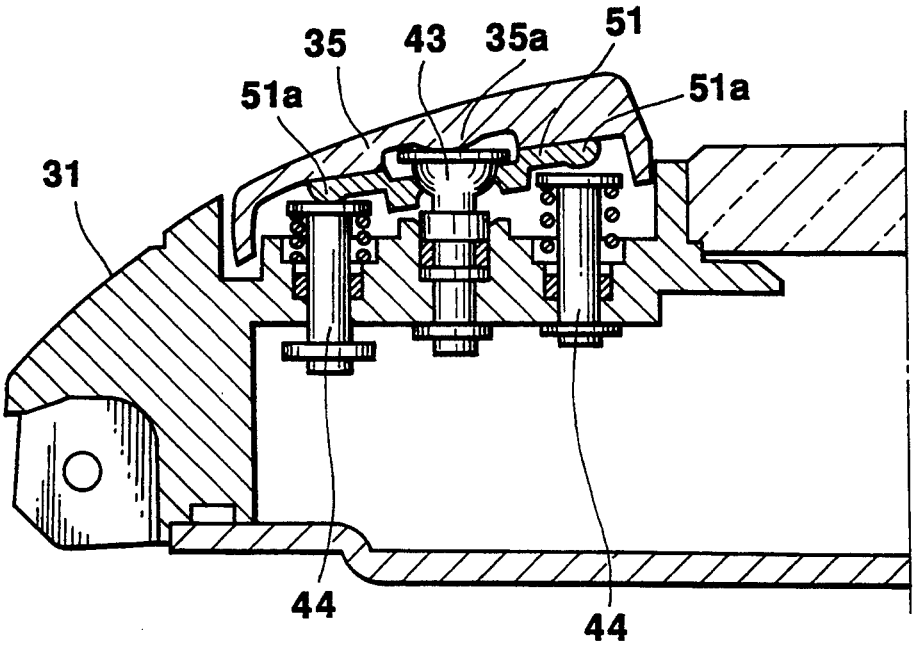
FIG. 7 is a sectional view of the switch of FIG. 4 indicative of operation of the switch.

The operating button 35 of a synthetic resin or the like covers the front ends of the fixed and movable shafts 43 and 44. The center of the interior or rear surface of the operating button 35 defines a depression 50 receiving part of the front end 43*a* of the fixed shaft 43. The center of the bottom of the depression 50 has a spherical boss 35*a* in point-contact with the front surface 43*a* of the fixed shaft 43. Thereby, the operating button 35 can be freely oscillated about the contact point between the boss 35*a* and the front surface 43*a* of the fixed shaft 43. The interior or rear surface of the operating button 35 has a spacer 51 of a synthetic resin attached thereto by ultrasonic welding or the like about the front end 43*a* of the fixed shaft 43. The spacer 51 is in and out of contact with the front ends 44*a* of the movable shafts 44. The periphery of the interior surface of the spacer 51 has four spherical bosses 51*a* in and out of point-contact with the front surfaces of the movable shafts 44, as shown in FIG. 6 and 7. Depressing the operating button 35 causes a particular boss 51*a* of the spacer 51 to depress a corresponding movable shaft 44.

The center of the spacer 51 has a bearing 51*b* defining a central hole and snugly fitting the front end 43*b* of the fixed shaft 43, so that the operating button 35 cannot be inadvertently rotated.

In FIGS. 5–7, a watch glass mounted on the front of the casing 31 is denoted at 61 and a bottom lid attached to the rearmost portion of the casing 31 is denoted at 62.

FIGS. 6 and 7 show operation of the switch 34 according to EXAMPLE 2 of the present invention. FIG. 6 shows that the UP side of the operating button 35 is depressed to depress a right-hand movable shaft 44. FIG. 7 shows that the DOWN side of the operating button 35 is depressed to depress a left-hand movable shaft 44. Depressing the UP, DOWN, FWD or REV side oscillates the operating button 35 about the contact point between the boss 35*a* and the front surface 43*a* of the fixed shaft 43. In this case, since a corresponding boss 51*a* is in point-contact with the front surface 44*a* of the movable shaft 44, the movable shaft 44 is not inclined but slides along the axis of the through-hole 42 to perform a switching operation. The axial movement of each movable shaft 44 does not degrade the waterproofing performance of the O-ring 47.

Since each movable shaft 44 cannot scuff the wall of a corresponding through-hole 42, that movable shaft 44 smoothly slides along the axis of the through-hole 42 so that the user of the electronic wrist watch can perform a switching operation without a foreign feeling. In addition, since distances between the movable shafts 44 can be reduced without a problem in the sliding of the movable shafts 44, the size of the switch 34 can be reduced.

The present invention is not restricted to the embodiments described above and can be variously modified or changed without departing from the scope of the invention. For example, the fixed shaft 43 may be integrated with the casing 31, which enhances the waterproofness of the interior of the switch 34. In addition, the operating button 35 and the spacer 51 may be integrally molded from a synthetic resin or the like.

The application of the present invention is not restricted to an electronic wrist watch. The present invention is applicable to electronic equipments such as watches other than a wrist watch, table-clocks, electronic note-books, pagers or game gears.

What is claimed is:

1. (Amended) A switch, comprising:

a casing having an antero-posterior axis and at least four through-holes, the through-holes extending along the antero-posterior axis of said casing;

a fixed shaft mounted to said casing, the fixed shaft having a flat portion at one end thereof and a hemispheric portion continuously connected to the flat portion, the through-holes being provided in the vicinity of said fixed shaft, and extending in four radial directions from the fixed shaft;

at least four movable shafts slidably received in the through holes respectively, the movable shafts each having a flat portion at one end thereof;

an operating button, having a shape so as to cover the flat portion of the fixed shaft and all of the flat portions of the movable shafts, said operating button being provided with an engaging portion which is pivotally supported by the hemispheric portion of the fixed shaft so that the operating button is pivotally supported by the fixed shaft, said operating button having a plurality of bosses, one of the bosses being in contact with the flat portion of said fixed shaft, the other bosses adapted to be brought into contact with the flat portions of said movable shafts; and a contact assembly mounted within said casing, for performing a switching operation in response to a sliding movement of one said movable shaft within the respective through hole.

2. The switch as recited in claim 1, wherein said fixed shaft is mounted within a hole defined in said casing

3. The switch as recited in claim 2, wherein said fixed shaft is mounted within a hole defined in said casing by means of a waterproofing packing.

4. The switch as recited in claim 1, further comprising waterproof packing means for stuffing a clearance between each of said movable shafts and corresponding one of the through holes.

5. The switch as recited in claim 1, wherein said contact assembly comprises movable contact means for urging said movable shafts toward the front of said casing and fixed contacts provided on a circuit card.

6. The switch as recited in claim 1, wherein the bosses have shapes to make point-contact with the flat regions of said fixed and movable shafts.

7. The switch as recited in claim 1, wherein said operating button comprises a front element having a front surface with a printed mark for operation, and a spacer provided on a rear surface of the front element, the spacer having the engaging portion and the bosses for making point-contact with the flat portions of said movable shafts.

8. The switch as recited in claim 1, wherein said casing is a casing of a wrist watch.

* * * * *